US005226237A

United States Patent [19]

Rancour et al.

[11] Patent Number: 5,226,237

[45] Date of Patent: Jul. 13, 1993

[54] FLEXIBLE DUCT CUTTER HAND TOOL

[75] Inventors: James K. Rancour; Jerome F. Fries, both of St. Cloud; David F. Salzl, Watkins, all of Minn.

[73] Assignee: Malco Products, Inc., Annandale, Minn.

[21] Appl. No.: 885,049

[22] Filed: May 18, 1992

[51] Int. Cl.[5] ..... B26B 17/00; B26B 9/00; B26B 11/00

[52] U.S. Cl. ..... 30/187; 30/191; 7/158

[58] Field of Search ..... 30/187, 188, 189, 190, 30/191, 192, 244, 245, 272; 7/151, 158

[56] References Cited

U.S. PATENT DOCUMENTS

| | | | |
|---|---|---|---|
| Re. 30,613 | 5/1981 | Nakamura et al. | 30/190 |
| 159,598 | 2/1875 | Megee | 7/158 |
| 1,401,546 | 12/1921 | Mae | 30/191 |
| 4,094,064 | 6/1978 | Nishikawa et al. | 30/192 |
| 4,283,805 | 8/1981 | Stacy | 7/127 |
| 4,441,388 | 4/1984 | Manor | 30/191 |
| 4,648,145 | 3/1987 | Miceli | 7/158 |
| 5,029,355 | 7/1991 | Thai | 7/158 |

FOREIGN PATENT DOCUMENTS

| | | | |
|---|---|---|---|
| 491670 | 6/1919 | France | 30/191 |

*Primary Examiner*—Frank T. Yost
*Assistant Examiner*—Paul M. Heyrana, Sr.
*Attorney, Agent, or Firm*—Palmatier, Sjoquist & Helget

[57] ABSTRACT

A hand tool combination of a knife having a double edged blade for piercing and cutting duct insulation and a wire cutter swingably engaged with the knife for cutting wire embedded in the duct insulation. The hand tool includes two jaws. One jaw forms the double edged blade and includes an anvil. The other jaw includes a wire cutting edge. The jaws are drawn together to operate the wire cutter by squeezing handles engaged with the jaws. The handles are also manipulated to operate the blade.

16 Claims, 3 Drawing Sheets

FLEXIBLE DUCT CUTTER HAND TOOL

BACKGROUND OF THE INVENTION

The present invention relates to hand tools and, more particularly, to a hand tool combination of a knife and wire cutter for cutting a fibrous flexible duct containing a spiral wire coil.

A flexible duct is an insulating duct having a spiral wire rib coil embedded in the duct for supporting the duct and permitting the duct to be flexed or bent to a particular angle such that the flexible duct may be customized to fit different ceilings and walls. As part of such a customized installation, the outer skin, insulation, inner liner, and wire coil of the duct are cut to form a section of duct of desired length.

SUMMARY OF THE INVENTION

A feature of the present invention is the provision in a hand tool for cutting a wire reinforced insulation duct, the tool having a pair of handles swingably mounted relative to each other and a pair of jaws engaged with the handles and swingable relative to each other, of one of the jaws forming a blade with an elongate cutting edge for cutting duct, and of the jaws having confronting faces defining a wire cutter.

Another feature is the provision in such a hand tool, of the handles being releasably lockable relative to each other whereby the blade may be utilized when the handles are locked and whereby the wire may be cut when the handles are unlocked.

Another feature is the provision in such a hand tool, of resilient means engaged with the handles for resiliently biasing the handles apart from each other to accept a wire to be cut between the jaws.

Another feature is the provision in such a hand tool, of each of the handles articulating relative to each of the jaws to provide for compound leverage for cutting the wire.

Another feature is the provision in such a hand tool, of the blade being double edged.

An advantage of the present hand tool is that it performs dual functions. It cuts both fiberglass insulation duct and the wire embedded in the duct.

Another advantage is that the present hand tool may be operated by one hand. Each of the functions of cutting the duct and of cutting the wire may be performed by the same hand. Moreover, the handles may be easily locked and unlocked by the thumb on the hand gripping the tool.

Another advantage is that flexible insulation duct may be cut more quickly. Hence, duct work may be installed more quickly and more efficiently.

Another advantage is that the present hand tool is comfortable to use overhead and in tight areas.

Another advantage is that a worker utilizing the present hand tool is able to switch back and forth quickly between fiberglass cutting and wire cutting.

Another advantage is that the present hand tool easily pierces the jacket of the flexible insulation duct.

Another advantage is that a worker utilizing the present hand tool may pierce the flexible duct and then cut the duct in both circumferential directions without removing the hand tool from the duct or twisting the hand tool therein.

DETAILED DESCRIPTION OF THE PREFERRED EMBODIMENTS

Figure 1:
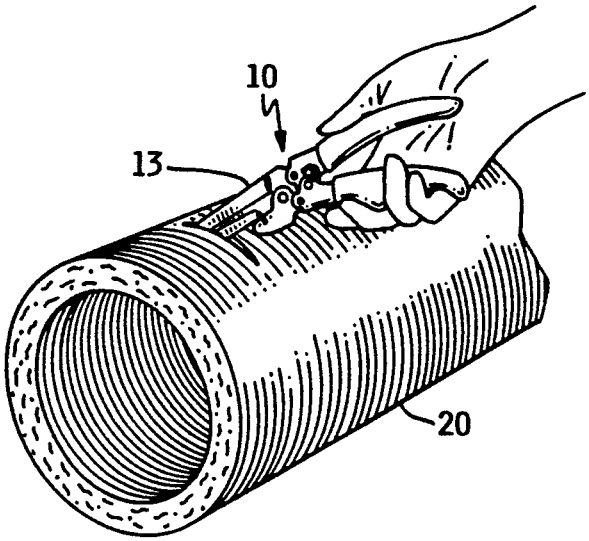
FIG. 1 is a perspective view of the present hand tool in its locked position for piercing and cutting flexible duct.
Figure 2:
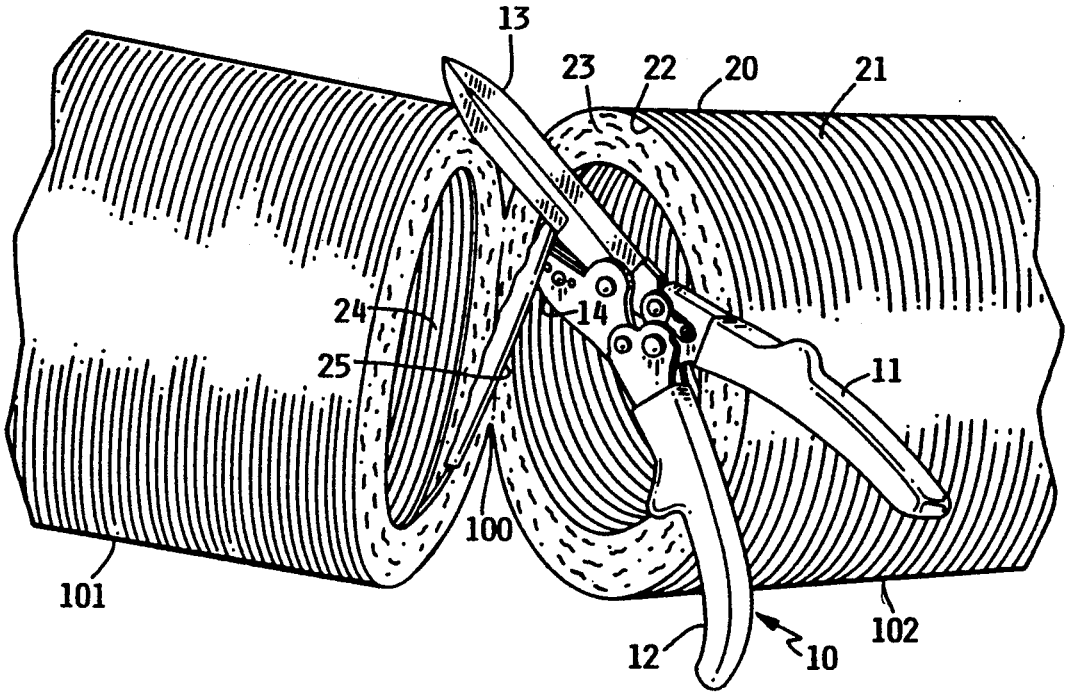
FIG. 2 is a perspective view of the present hand tool of FIG. 1 in its unlocked position for receiving a wire of the flexible duct to be cut.

The present flexible duct cutter hand tool is indicated in general by the reference numeral 10. It includes a pair of handles 11, 12 swingably mounted relative to each other, a pair of jaws 13, 14 engaged with the handles 11, 12, respectively, and swingable relative to each other when the handles 11, 12 are squeezed, a blade 15 on the jaw 13, and a wire cutter 16 on the other jaw 14.

The hand tool 10 cuts flexible duct 20. Flexible duct 20 typically includes an outer skin or aluminum jacket 21 having a spiral wire rib coil 22 fixed immediately inwardly thereof, a relatively thick middle layer of fiberglass insulation 23, an inner liner 24 formed of aluminum, and a spiral wire rib coil 25 disposed immediately outwardly of and fixed to the inner liner 24. It should be noted that fiberglass, such as the fiberglass insulation 23, is a relatively hard material that rapidly dulls sharpened metal edges. It should also be noted that the wire of the wire coils 22, 25 is typically formed of a relatively hard wire which may be difficult to cut.

Each of the handles 11, 12 includes respective upper plate sections 30, 31 and respective lower plate sections 32, 33 which are joined by respective end plate sections 34, 35. Each of the plate sections 30, 32, 34 and 31, 33, 35 of each of the handles 11, 12 forms a U-channel in cross-section from respective front ends 36, 37 to respective rear ends 38, 39.

The handles 11, 12 include respective non-slip vinyl grips 40, 41 with respective protruding stops 42, 43. The grips 40, 41 include respective open ends 44, 45 and closed ends 46, 47 such that the grips 40, 41 are slidable onto the handles 11, 12. With the grips 40, 41, the hand tool 10 is less likely to slip out of one's sweaty hand when working in hot attics or crawl spaces.

The handles 11, 12 are pivotally connected to each other via a pin connector or rivet connection 50. The pin connector 50 extends through upper and lower plates 30, 31, 32, 33. The portions of the plates 30, 32 of handle 11 which are adjacent to the pin connector 50 are disposed inside the portions of the plates 31, 33 of handle 12 which are adjacent to the pin connector 50.

A resilient means or torsion spring 55 is engaged between the handles 11, 12 to resiliently bias the handles 11, 12 apart from each other and to in turn bias the jaws 13, 14 apart from each other for accepting wire 25 to be cut. The torsion spring 55 engages the pin connector 50 and includes spring arms 56, 57 which engage the respective end plate sections 34, 35 of the handles 11, 12 to press the handles 11, 12 apart.

A releasable locking means or tab lock 60 is engageable between the handles 11, 12 to lock the handles 11, 12 and jaws 13, 14 in a relatively nonswingable confronting position for operating the blade 15 for cutting the fiberglass insulation 23. The tab lock 60 includes a locking edge 61 for engaging a locking edge or notch 62 formed in the upper plate section 31 of handle 12. The tab lock 60 is pivotally fixed to the upper plate section 30 of handle 11 via a pin connector 63. The tab lock 60 further includes an upright tab portion 64 for being manipulated by a thumb or finger for turning the lock 60. When the locking edges 61, 62 are engaged with each other, the handles 11, 12 and jaws 13, 14 are prevented from being pushed apart by the torsion spring 55. When the lock 60 is turned to disengage edge 61 from edge 62, the torsion spring 55 pushes the handles 11, 12 apart and, accordingly, the jaws 13, 14 are drawn apart to accept one of the wires 22, 25.

The jaw 13, which includes the blade 15, is pivotally connected between the upper and lower plate sections 30, 32 of handle 11 via a pin connector or rivet connection 70. The double-edged blade 15 includes a first elongate cutting edge 73 and a second, shorter, elongate cutting edge 74. The edges 73, 74 generally oppose each other. The elongate cutting edges 73, 74 include respective tapering portions 75, 76 which taper toward each other to intersect to form a piercing, tapering tip 77 for piercing the outer jacket 21, fiberglass insulation 23, and inner lining 24. It should be noted that the blade 15 is formed of a stainless steel and includes respective concave elongate faces or hollow grinds 78, 79 running adjacent to the cutting edges 73, 74 to provide high quality, durable cutting edges 73, 74 which may be more easily re-sharpened. Blade 15 and handle 11 may be referred to as a knife.

The jaw 14, which includes the wire cutter 16, is formed of respective, upper and lower plate sections 80, 81. Portions of the plate sections 80, 81 are disposed between portions of the plate sections 31, 33 of handle 12 and are pivotally connected thereto by a pin connector or rivet connection 82. The jaw 14 is also pivotally connected to the jaw 13 by a pin connector or rivet connection 83. A portion of the jaw 13 adjacent to the pin connector 83 is disposed between the plate sections 80, 81 of the jaw 14.

The wire cutter 16 includes a sharpened edge or face 84 for pinching and cutting one of the wires 22, 25 against a confronting flat anvil or face 85 formed on jaw 13. The confronting anvil 85 is a relatively dull, relatively flat anvil which runs parallel to the sharpened edge 84 when the handles 11, 12 are squeezed together to a maximum degree, which is defined as the point where the edge 84 and anvil 85 engage each other.

Figure 3:
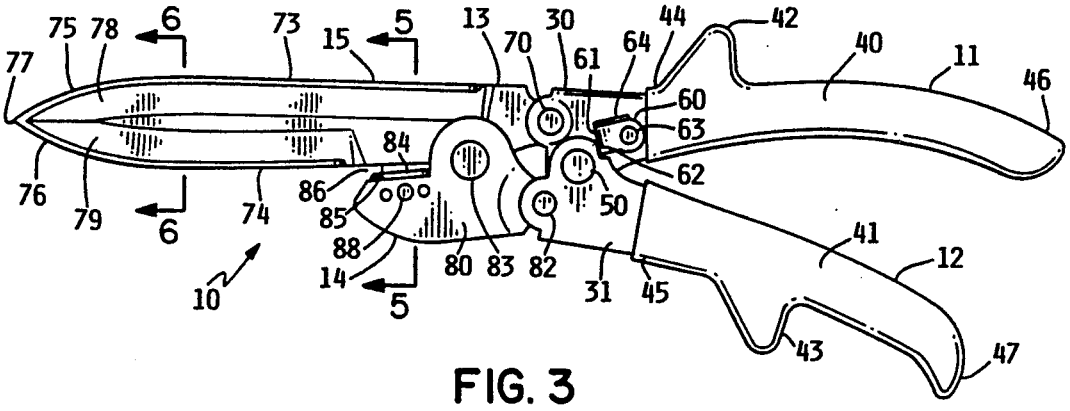
FIG. 3 is a detail elevation view of the hand tool of FIG. 1 in its locked position.
Figure 4:
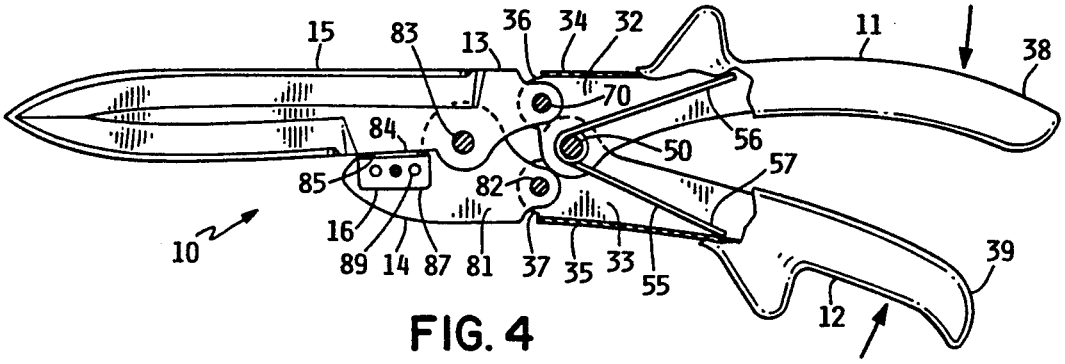
FIG. 4 is a detail elevation, partially broken away view of the hand tool of FIG. 1 in its closed or confronting position for pinching and cutting a wire of the duct of FIG. 1.
Figure 5:
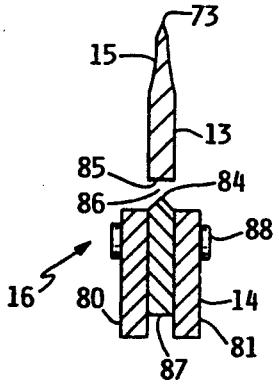
FIG. 5 is a section view at lines 5—5 of FIG. 3.
Figure 6:
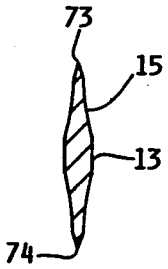
FIG. 6 is a section view at lines 6—6 of FIG. 3.

It should be noted that FIG. 3 reflects a locked position for the hand tool 10. That is, the tab lock 60 is closed to engage handle 12 to prevent the handles 11, 12 or jaws 13, 14 from spreading. However, from such a position, the handles 11, 12 may be slightly squeezed together to draw the jaws 13, 14 together to close a wire receiving space 86 which is defined by the edge 84 and anvil 85. Accordingly, if desired, the tab lock 60 may remain closed while one of the wires 22, 25 to be cut is slid between the wire engaging edge 84 and the anvil 85. This locking position provides for only such limited swinging of the handles 11, 12 and jaws 13, 14 so that the blade 15 may be safely used Without the handles 11, 12 articulating to a great degree relative to the blade 15.

It should be noted that the wire cutting edge 84 is formed on a hardened piece 87 of steel which is rigidly fixed to and between the plate sections 80, 81 via a pin connector 88 and alignment pins 89.

In operation, to cut the flexible duct 20, the blade 15 is punched into the duct 20 through the outer jacket 21, fiberglass insulation 23, and inner liner 24. The blade 15 is then manipulated in a sawing motion in either direction around the duct 20 to cut the fiberglass insulation 23 as well as the outer jacket 21 and inner liner 24. Typically, a worker leaves a small connecting strip 100 for stabilizing the now almost separated duct portions 101, 102 relative to each other while he or she cuts the wire coils 22, 25. After the wire coils 22, 25 are snipped or pinched, the connecting strip 100 is cut by the blade 15.

When the blade 15 is utilized in such a duct cutting operation, the tab lock 60 is preferably closed. When the wire cutter 16 is utilized in such a duct cutting operation, the tab lock 60 is preferably opened such that the edges 61, 62 are disengaged. However, if desired, as noted above, the tab lock 60 may remain in its locked position for the wire pinching operation.

It should be noted that when the handles 11, 12 are squeezed together, the handles 11, 12 articulate with respect to each other and each of the jaws 13, 14, and the jaws 13, 14 articulate with respect to each other. Such articulation is provided by the pin connectors 50, 72, 82, 83 to create a compound leverage for pinching and cutting the relatively hard wires 22, 25.

Figure 7:
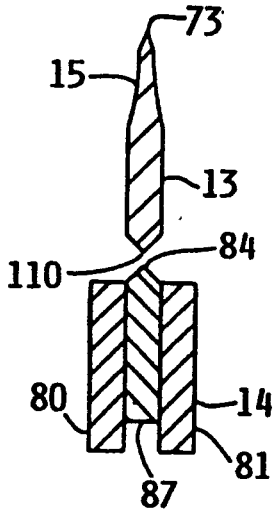
FIG. 7 is a section view of an alternate embodiment of the wire cutter of FIG. 5.

As shown in FIG. 7, a cutting edge 110 replaces the anvil 86. Accordingly, edges 110, 84 cooperate to pinch off a wire. Edge 110 may be an extension of cutting edge 74.

Figure 8:
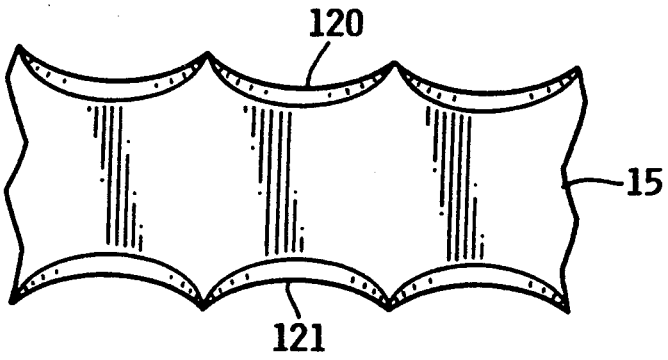
FIG. 8 is a partial, elevation view of an alternate embodiment of the blade of the tool of FIG. 3.

As shown in FIG. 8, the blade 15 may include serrated cutting edges 120, 121 to replace the cutting edges 73, 74.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A hand tool for cutting continuous wire reinforced insulation duct operable with one hand in overhead and tight areas, comprising a pair of handles swingably mounted relative to each other, a pair of forwardly directed jaws connected and substantially in-line with the handles and swingable relative to each other when the handles are manipulated, one of the jaws having a forwardly directed knife-like blade which includes a first elongate cutting edge for cutting the duct insulation with the one hand, and the jaws further comprising confronting faces below and along the knife-like blade which comprise a forwardly directed wire cutter, one of the faces comprising a wire cutting edge for cutting the continuous wire between the faces when the handles are manipulated by the one hand.

2. The hand tool of claim 1, further comprising releasable locking means engaged with the handles for releasably locking the handles relative to each other whereby the knife may be utilized when the handles are locked and whereby the wire may be cut when the handles are unlocked.

3. The hand tool of claim 1, further comprising resilient means engaged with the handles for resiliently biasing the handles apart from each other whereby the jaws are biased apart for accepting the wire to be cut.

4. The hand tool of claim 1, wherein one of the handles articulates relative to each of the jaws whereby leverage for cutting the wire is increased.

5. The hand tool of claim 1, wherein each of the handles articulates relative to each of the jaws whereby leverage for cutting the wire is increased.

6. The hand tool of claim 1, wherein the handles are pivotally connected together at a first location, the jaws being pivotally connected together at a second location, one of the jaws being pivotally connected to one of the handles at a third location, and the other of the jaws being pivotally connected to the other handle at a fourth location whereby leverage for cutting the wire is increased.

7. The hand tool of claim 1, wherein the blade includes a second elongate cutting edge generally opposite of the first elongate cutting edge whereby the blade is double edged.

8. The hand tool of claim 7, wherein each of the elongate cutting edges includes a tapering cutting edge portion, the tapering portions extending toward each other to form a piercing blade tip.

9. The hand tool of claim 1, wherein the wire cutting edge is formed of a material harder than the face it confronts.

10. The hand tool of claim 1, wherein the wire cutting edge and the blade extend in substantially the same directions.

11. The hand tool of claim 1, wherein the handles and the blade extend in substantially the same directions.

12. The hand tool combination of a double edged knife and wire cutter for cutting continuous wire reinforced insulation duct operable with one hand, comprising a knife having an in-line handle and a forwardly directed blade with a pair of opposing, elongate cutting edges, the elongate cutting edges forming a tapered piercing tip, and forwardly directed wire cutter means swingably engaged with the knife for cutting a wire and being disposed adjacent, along and below to one of the elongate cutting edges, the wire cutter means having confronting faces for cutting the continuous wire, the confronting faces forming a forward opening engaging the wire when the knife is moved in a forward direction.

13. A hand tool for cutting both duct insulation and wire, comprising a pair of handles pivotally connected to each other at a first location and including releasable locking means for releasably locking the handles relative to each other and resilient means for resiliently biasing the handles apart from each other, a pair of jaws engaged with the handles to be drawn together when the handles are squeezed, the jaws being pivotally connected to each other at a second location, one of the jaws being pivotally connected to one of the handles at a third location, the other of the jaws being pivotally connected to the other handle at a fourth location, one of the jaws having a double edge blade with a pair of first and second, opposed, elongate, cutting edges for cutting the duct insulation, and a shorter wire engaging anvil for engaging the wire, each of the elongate cutting edges having tapering portions tapering toward each other to form a piercing, tapered blade tip, and the other jaw having a sharpened, hardened, wire cutting edge extending transversely of and confronting the anvil of the jaw having the blade, the wire cutting edge and anvil being shorter in length than the elongate cutting edges whereby the blade is utilized to cut duct insulation and the wire cutting edge and anvil are utilized to clip wire.

14. The hand tool of claim 1, wherein the elongate cutting edge is serrated.

15. The hand tool of claim 1, wherein each of the wire cutting edges is knife-like.

16. A hand tool for cutting continuous wire reinforced insulation duct operable with one hand in overhead and tight areas, comprising a pair of handles swingably mounted relative to each other, a spring engaged between the handles for resiliently biasing the handles apart from each other, a pair of forwardly directed jaws connected and substantially in-line with the handles and swingable relative to each other when the handles are manipulated, one of the jaws having a forwardly directed knife-like blade with a tapered tip for piercing the duct insulation and a first elongate cutting edge for cutting the duct insulation with one hand, and the jaws further comprising confronting faces along the knife-like blade which comprise a forwardly directed wire cutter, one of the faces comprising a wire cutting edge for cutting the continuous wire between the faces when the handles are manipulated by the one hand, each of the faces having a shorter length than the first elongate cutting edge.

* * * * *